United States Patent [19]

Iwahara

[11] 4,192,969

[45] Mar. 11, 1980

[54] STAGE-EXPANDED STEREOPHONIC SOUND REPRODUCTION

[76] Inventor: Makoto Iwahara, c/o Victor Company of Japan, Limited, No. 3-12, Moriya-cho, Kanagawa-ku, Yokohama City, Japan

[21] Appl. No.: 940,461

[22] Filed: Sep. 7, 1978

[30] Foreign Application Priority Data

Sep. 10, 1977 [JP] Japan ..... 52-109174

[51] Int. Cl.[2] ..... H04R 5/04

[52] U.S. Cl. ..... 179/1 G

[58] Field of Search ..... 179/1 G, 1 GP, 1 D, 179/100.4 ST, 1 GQ

[56] References Cited

U.S. PATENT DOCUMENTS

| | | | |
|---|---|---|---|
| 4,118,599 | 10/1978 | Iwahara et al. | 179/1 GP |
| 4,136,260 | 1/1979 | Asahi | 179/1 G |
| 4,139,728 | 2/1979 | Haramoto et al. | 179/1 G |

FOREIGN PATENT DOCUMENTS

| | | | |
|---|---|---|---|
| 2308267 | 11/1976 | France | 179/1 G |

*Primary Examiner*—Douglas W. Olms

[57] ABSTRACT

A stereophonic reproduction system comprises a localization network receptive of sterophonic signals to localize of sonic images at desired locations. A crosstalk canceler, connected in tandem with the localization network, cancels acoustic crosstalk interference. The localization network comprises in each channel a first adder providing algebraic summation of the input signal of the own channel and a negative feedback signal supplied from its output through a first subtractor and through a first transfer circuit having a transfer function representing the ratio of hypothetical crosstalk path transfer function to hypothetical direct path transfer function. The subtractor also responds to the signal of the other channel to algebraically combine the received signal in phase through the first transfer circuit with the input signal of the own channel. The crosstalk canceler comprises in each channel a second adder providing algebraic summation of the signal from the first adder and the signal of the same channel through a second subtractor and a second transfer circuit having a transfer function representing the ratio of actual crosstalk path transfer function to actual direct path transfer function. The second subtractor also responds to the signal from the second adder of the other channel to combine the received signal with the signal from the first adder in opposite phase through the second transfer circuit. Attenuators permit manual adjustment of signals supplied to the first and second subtractors of each channel.

5 Claims, 4 Drawing Figures

STAGE-EXPANDED STEREOPHONIC SOUND REPRODUCTION

BACKGROUND OF THE INVENTION

The present invention relates generally to stereophonic sound reproduction systems, and in particular to such a system wherein the stereo signals are processed to produce illusion of expanded stage width to a listener with acceptable sound quality for input stereophonic signals with different degrees of correlation between right and left channels.

U.S. Pat. application No. 772,149 filed Feb. 25, 1977 now U.S. Pat. No. 4,118,599 and assigned to the same assignee of the present invention discloses stage-expanded systems for reproduction of stereophonic signals. The system disclosed in FIG. 21 of the application comprises a binaural localization network and a crosstalk cancellation network connected in tandem therewith to drive loudspeakers with binaurally correlated localized, crosstalk-free signals. The binaural localization network comprises a first adder having a first input connected to receive a right-channel stereo signal, a second adder having a first input in receipt of a left-channel stereo signal, a first subtractor which provides algebraic subtration between the right-channel input signal and the output signal from the second adder to provide a subtraction output which is coupled through a first transfer circuit to a second input of the first adder so that the direct right-channel input signal and the translated right-channel signal are combined together in reverse phase and the direct right-channel signal and and the left-channel output signal are combined together in phase. This transfer circuit has a transfer function $B_i/A_i$ where $A_i$ is the transfer function of an acoustic paths between hypothetical loudspeakers and the nearside ears of a listener and $B_i$ is the transfer function acoustic crosstalk paths between the hypothetical speakers and the far-side ears of the listener. In the same fashion, algebraic subtraction is effected in a second subtractor between the left-channel input signal and the right-channel output signal from the first adder to supply its output through a second transfer circuit having the same transfer function as the first transfer circuit to the second input of the second adder so that the direct left-channel signal and the translated left-channel signal are combined together in reverse phase and the direct left-channel signal and the right-channel output signal are combined together in phase. The crosstalk cancellation circuit of the disclosed system is receptive of the right- and left-channel localized output signals from the localization network to develop a pair of output signals for application to the loudspeakers without producing the effect of acoustic crosstalk which might be perceptible by the listener if the localized output signals from the localization network were separately supplied directly to the loudspeakers.

Mathematical analysis of the prior art system has revealed that when the input signals have a high degree of correlation, that is, those signals derived from a sound source located at or near the center of the stage width, the system ensures good sound quality reproduction. However, when the input signals have a lesser degree of correlation, that is, those signals derived from different sound sources located separately at the extreme ends of the stage width, the sound quality was found unacceptable due to degraded frequency response. In the aforesaid application, there is also disclosed a system which assures good sound quality reproduction in respect to stereo signals with lesser degree of correlation. However, reproduction of signals with higher degree of correlation was found to be unacceptable in terms of sound quality.

SUMMARY OF THE INVENTION

The primary object of the invention is to provide a system which permits reproduction of audio signals having any degree of correlation with acceptable degree of sound quality, while at the same time giving an illusion of an expanded stage width to the listener.

The aforesaid object is achieved by the combination of a binaural localization network and a crosstalk cancellation networks. The localization network comprises a first adder receptive of a left-channel stereo input signal, a first subtractor receptive of an output signal from the first adder to algebraically combine it with a right-channel stereo input signal to supply its output signal to a first transfer circuit with a transfer function representative of the ratio of acoustic transfer characteristic of crosstalk to direct paths between hypothetical speakers and the listener's ears and thence to a second input of the first adder, whereby the output signal from the first adder is negatively fed fack thereto through the subtractor and transfer circuit and the right-channel input signal is algebraically added to the left-channel signal. A second adder is connected to receive the right-channel input signal and an output signal from a second transfer circuit having the same transfer function as the first transfer circuit. The second transfer circuit receives an input signal from a second subtractor which algebraically combines the left-channel input signal with the output signal from the second adder, whereby the output from the second adder is negatively fed back thereto through the second subtractor and second transfer circuit and the left-channel input signal is algebraically added to the right-channel input signal.

The crosstalk cancellation circuit includes a third adder receptive of the left-channel output signal from the first adder of the localication network and also an output signal from a third transfer circuit having a transfer function representative of the ratio of acoustic transfer characteristics of crosstalk to direct paths between actual speakers and the listener's ears. The third transfer circuit receives its input signal from a third subtractor which algebraically combines the left-channel signal from the localization network and an output signal from a fourth adder. This fourth adder receives the right-channel output signal from the localization network and an output signal from a fourth transfer circuit having the same transfer function as the third transfer circuit. The fourth transfer circuit in turn receives its input signal from a fourth subtractor which algebraically combines the right-channel output signal from the localization network with the output signal from the third adder. The output signals from the third and fourth adders are used to drive the loudspeakers.

The negative feedback signals from the first and second adders are proportioned in amplitude by means of a first set of ganged variable attenuators to provide a suitable frequency response. The input signals to the third and fourth subtractors from the localization networks are also proportioned in amplitude by a second set of ganged variable attenuators so as to give a frequency response in conjunction with the adjustment of the first set of attenuators. At one extreme of the adjustment, signals with a high degree of correlation are faithfully reproduced, while at the opposite end of the adjustment signals with a low degree of correlation are faithfully reproduced. Adjustment at an intermediate value assures reproduction of signals of differing degrees of correlation with an acceptable degree of fidelity over the audio frequency spectrum.

BRIEF DESCRIPTION OF THE DRAWINGS

The invention will be further described in detail by way of example with reference to the accompanying drawings, in which.

DETAILED DESCRIPTION

Figure 1:
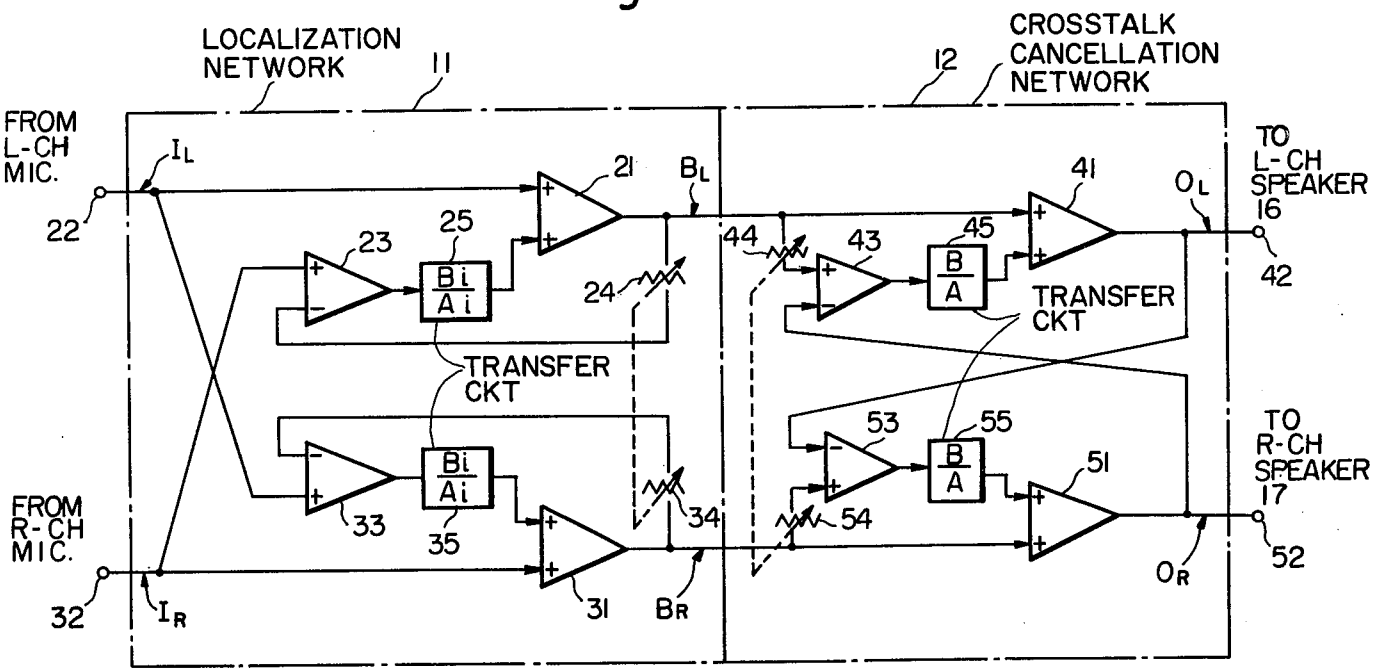
FIG. 1 is a block diagram of a preferred embodiment of the invention.

FIG. 1 illustrates a first preferred embodiment of the stage expansion system of the invention which generally comprises a binaural localization network 11 and a crosstalk cancellation network 12 connected in tandem with the localization network 11. The localization network 11 is shown comprised by a left-channel adder 21 having a first input connected to receive a left-channel stereophonic signal $I_L$ applied to a left-channel input terminal 22 and a right-channel adder 31 having a first input connected to receive a right-channel stereo signal $I_R$ applied to a right-channel input terminal 32. The output signals from the left- and right-channel adders are fed back to the inverting inputs of unity-gain differential amplifiers or subtactive circuits 23 and 33 respectively through respective variable attenuators 24 and 34 which are ganged together. The input stereo signals are cross-coupled so that the left-channel signal $I_L$ is applied to the noninverting input of the right-channel subtractor 33 and the right-channel stereo signal $I_R$ is applied to the noninverting input of the left-channel subtractor 23. The output from the left-channel subtractor 23 is connected to the second input of the adder 21 through a left-channel transfer circuit 25 having a transfer function $B_i/A_i$ which simulates the reproduction of sound components having characteristics of the acoustic crosstalk and direct paths between hypothetical loudspeakers located outside of the actual loudspeakers and the listeners, ears, as will be described later. Similarly, the output signal from the right-channel subtractor 33 is connected to the second input of the adder 31 through a right-channel transfer circuit 35 having the same transfer function as the left-channel transfer circuit 25.

The crosstalk cancellation network 12 comprises a left-channel adder 41 and a right-channel adder 51 connected to receive the left- and right-channel output signals $B_L$ and $B_R$ from the localization network 11 at their first input terminals to deliver left- and right-channel output signals $O_L$ and $O_R$ to output terminals 42 and 52, respectively. The left-channel output signal $O_L$ is fed back to the inverting input of a right-channel subtractor 53 to be algebraically combined with the left-channel signal $B_R$ which is applied through a variable attenauator 54 to its noninverting input terminal, the output signal of the subtractor 53 being coupled to the second input of the adder 51 through a transfer circuit 55 having a transfer function B/A which simulates the reproduction of sound components having characteristics of the acoustic crosstalk and direct paths between the actual loudspeakers and the listener's ears, which will be described below. In a similar fashion, the right-channel output signal $O_R$ is fed back to the inverting input of a left-channel subtractor 43 to be algebraically combined with the left-channel signal $B_L$ which is applied through a variable attenuator 44 which is ganged to the attenuator 54. The output signal from the subtractor 43 is coupled to the second input of the adder 41 through a left-channel transfer circuit 45 having the same transfer function as the right-channel transfer circuit 55.

Consider now the mathematical relationship between the input and output signals of the stage expansion system of FIG. 1. A mathematical analysis of the binaural localization network 11 is given as follows:

$$\begin{bmatrix} B_R \\ B_L \end{bmatrix} = \frac{1}{A_i + K_1 \cdot B_i} \begin{bmatrix} A_i & B_i \\ B_i & A_i \end{bmatrix} \begin{bmatrix} I_R \\ I_l \end{bmatrix} \tag{1}$$

Figure 2:
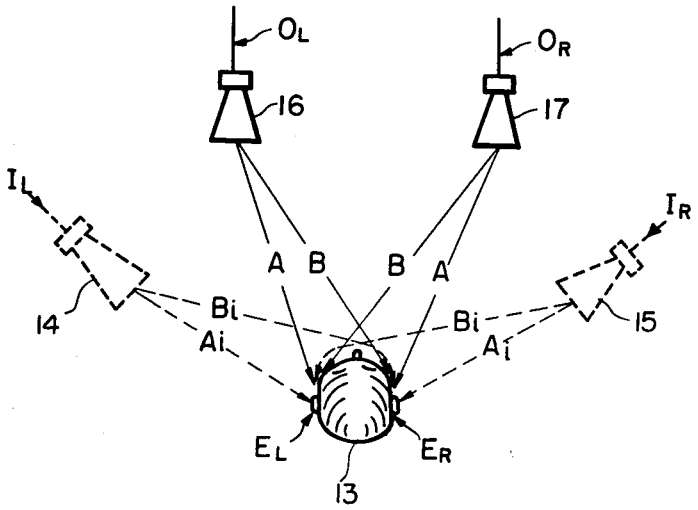
FIG. 2 is an illustration of geometric relationships of actual and hypothetical loudspeakers to listener's ears in an expanded stage.

Equation 1 indicates that the input stereo signals $I_R$ and $I_L$ have been so translated that the localized output signals $B_R$ and $B_L$ produces sound pressures which will give a psychological effect that the virtual sound sources are present at the positions indicated in phantom lines 14 and 15 in FIG. 2 which are outside of the actual loudspeakers 16 and 17, where $A_i$ is the transfer function of acoustic paths from the hypothetical loudspeakers 14 and 15 to the near-side ears of the listener 13 and $B_i$ is the transfer function of crosstalk paths from the hypothetical loudspeakers to the far-side ears of the listener as indicated by broken lines, and $K_1$ is the scaling factor of the attenuators 24 and 34.

The crosstalk cancellation network 12 can be mathematically represented by the following relation:

$$\begin{bmatrix} O_R \\ O_L \end{bmatrix} = \frac{1 + K_2 \cdot B/A}{1 - (B/A)^2} \begin{bmatrix} 1 & -B/A \\ -B/A & 1 \end{bmatrix} \begin{bmatrix} B_R \\ B_L \end{bmatrix} \tag{2}$$

Rearranging Equation 2, $$\begin{bmatrix} O_R \\ O_L \end{bmatrix} = \frac{A + K_2 \cdot B}{(A + B)(A - B)} \begin{bmatrix} A & -B \\ -B & A \end{bmatrix} \begin{bmatrix} B_R \\ B_L \end{bmatrix} \tag{3}$$

where A is the transfer function of acoustic paths between the actual speakers 16 and 17 and the near-side ears of the listener 13 and B is the transfer function of cross-talk paths between the actual speakers and the far-side ears of the listner, and $K_2$ is the scaling factor of the attenauators 44 and 54. From Equations 1 and 3 the following relation holds:

$$\begin{bmatrix} O_R \\ O_L \end{bmatrix} = \frac{A + K_2 B}{(A + B)(A - B)} \begin{bmatrix} A & -B \\ -B & A \end{bmatrix} \frac{1}{A_i + K_1 B_i} \begin{bmatrix} A_i & B_i \\ B_i & A_i \end{bmatrix} \begin{bmatrix} I_R \\ I_L \end{bmatrix} \tag{4}$$

If the attenuators 24, 34, 44 and 54 are so adjusted the $K_1=K_2=0$, then the following relation will be obtained:

$$\begin{bmatrix} O_R \\ O_L \end{bmatrix} = \frac{A}{(A+B)(A-B)} \begin{bmatrix} A & -B \\ -B & A \end{bmatrix} \frac{1}{A_i} \begin{bmatrix} A_i B_i \\ B_i A_i \end{bmatrix} \begin{bmatrix} I_R \\ I_L \end{bmatrix} \quad (5)$$

According to experiments A is found to be substantially equal to $A_i$. Therefore, $$\begin{bmatrix} O_R \\ O_L \end{bmatrix} = \frac{1}{(A+B)(A-B)} \begin{bmatrix} A & -B \\ -B & A \end{bmatrix} \begin{bmatrix} A_i B_i \\ B_i A_i \end{bmatrix} \begin{bmatrix} I_R \\ I_L \end{bmatrix} \quad (6)$$

Thus, $$\begin{bmatrix} O_R \\ O_L \end{bmatrix} = \begin{bmatrix} A & B \\ B & A \end{bmatrix}^{-1} \begin{bmatrix} A_i & B_i \\ B_i & A_i \end{bmatrix} \begin{bmatrix} I_R \\ I_L \end{bmatrix} \quad (7)$$

Referring again to FIG. 2, the output signals $O_L$ and $O_R$ from the stage expansion system of FIG. 1 are applied to the left- and right-channel loudspeakers 16 and 17, so that the following mathematical relations hold between the speaker input signals and the resultant sound pressures $E_R$ and $E_L$ at the listener's right and left ears, respectively:

$$\begin{bmatrix} E_R \\ E_L \end{bmatrix} = \begin{bmatrix} A & B \\ B & A \end{bmatrix} \begin{bmatrix} O_R \\ O_L \end{bmatrix} \quad (8)$$

Since $O_R$ and $O_L$ are given in Equation 7, the sound pressures $E_R$ and $E_L$ are given as follows:

$$\begin{bmatrix} E_R \\ E_L \end{bmatrix} = \begin{bmatrix} A_i & B_i \\ B_i & A_i \end{bmatrix} \begin{bmatrix} I_R \\ I_L \end{bmatrix} \quad (9)$$

Equation 9 describes a reproduction in which input signals $I_R$, $I_L$ are directly applied to hypothetical speakers 14 and 15 respectively, which is equivalent to the reproduction in which the processed signals $O_R$, $O_L$ are applied to actual speakers 16, 17 respectively as given by Equation 8.

If the original sound sources are located at the extreme ends of the sound stage separately there is a less degree of correlation between right- and left-channel signals. If such less-correlated stereo signals are supplied to the input terminals 22, 32, the listener would have the impression as if sounds come from the positions where hypothetical speakers 14 and 15 are located and under these circumstances the quality of the impressed sound is acceptable. Equation 9 describes such situations. However, if input stereo signals have a greater degree of correlation between them such as those derived from a sound source located in the midst of the stage so that $I_R$ can be considered to be substantially equal to $I_L$ (that is, $I_R=I_L=I$), the output signals for driving the speakers 14 and 15 will be affected in frequency response. By substituting I for $I_R$ and $I_L$ of Equation 6, the output signals $O_R$ and $O_L$ will be given as follows:

$$O_R = O_L = \frac{A_i + B_i}{A + B} I \quad (10)$$

Next consider the case in which the attenuators 24, 34, 44 and 54 are so adjusted that $K_1=K_2=1$, and consequently Equation 4 is rewritten as follows:

$$\begin{bmatrix} O_R \\ O_L \end{bmatrix} = \frac{1}{A-B} \begin{bmatrix} A & -B \\ -B & A \end{bmatrix} \frac{1}{A_i + B_i} \begin{bmatrix} A_i & B_i \\ B_i & A_i \end{bmatrix} \begin{bmatrix} I_R \\ I_L \end{bmatrix} \quad (11)$$

If the signals $I_R=I_L=I$ in phase and signal level, then $O_R=O_L=I$. This means that the sound quality of the sonic images at the midst of the stage is acceptable.

Therefore, with $K_1=K_2=1$ the lightly correlated signals undergo transformation of $(A+B)/(A_i+B_i)$, which is the inverse of the transfer function of Equation 10 obtained for heavily correlated signals with $K_1=K_2=0$. Therefore, the adjustment of the attenuators 24, 34, 44, 54 to provide a scaling factor between 0 and unity will result in the production of sonic images of acceptable sound quality at locations intermediate the extreme ends of the stage and the sound quality in this case may be compromise between the sound quality obtained with a scaling factor 0 and that obtained with a scaling factor 1 and such adjustment is most suitable for reproduction of orchestral music where sound sources are located over the substantial area of the stage. Differently stated, the listener is given a choice between a reproduction in which emphasis is placed on the sound quality of the heavily correlated signals derived from a sound source located at or near the midst of the stage and a reproduction in which emphasis is placed on the sound quality of the light correlated signals derived from different sound sources located separately at the extreme ends of the stage.

Figure 3:
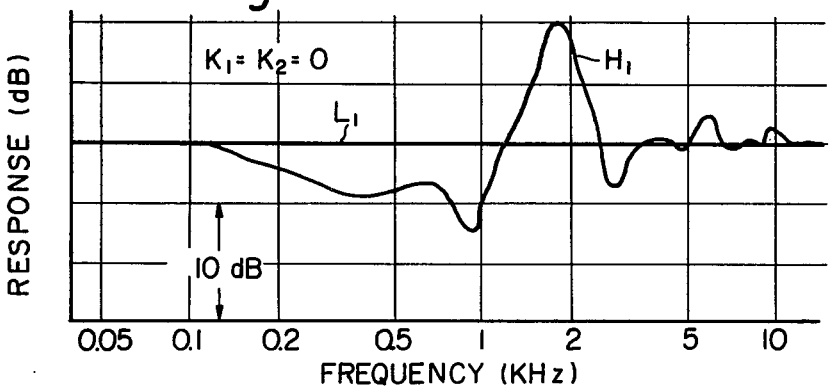
FIGS. 3 to 5 are graphic illustrations of the frequency response characteristics of the system in respect of the signals having high and low degrees of binaural correlation with scaling factor being adjusted at zero, unity and 0.5, respectively.
Figure 4:
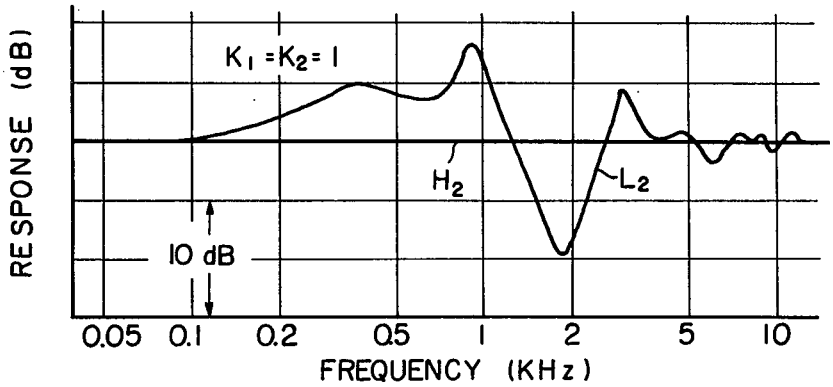
Figure 5:
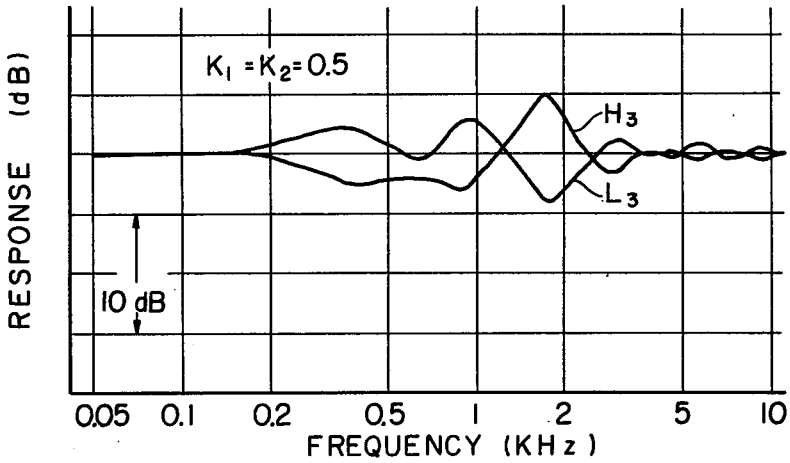

The frequency response characteristics of the system are graphically illustrated in FIGS. 3 to 5. With $K_1=K_2=0$, the system exhibits a response indicated by curve $H_1$ in FIG. 3 in respect of the heavily correlated stereo signals and a response indicated by curve $L_1$ in respect of the lightly correlated stere signals. Curve $H_1$ is characterized with a 10 dB positive peak near 2 kHz and a 8 dB negative peak near 1 kHz. In contrast, curve $L_1$ is characterized with a flat response over the full range of the audible frequency spectrum. On the other hand, FIG. 4 shows that with $K_1=K_2=1$ the system exhibits a flat response of the heavily correlated signals as indicated by curve $H_2$, while its response to the lightly correlated signals is as indicated by curve $L_2$ which is characterized by a 8 dB positive peak near 1 kHz and a 10 dB negative peak near 2 kHz. It is noted that the curve $L_2$ of FIG. 4 is inverse to the curve $H_1$ of FIG. 3. Therefore, it is understood that within the adjustment range of from 0 to unity, the response characteristics of the system in respect to the heavily and lightly correlated signals vary from one end of the scale to the other whereupon the response is reversed. FIG. 5 illustrates the response for a scaling factor of 0.5. It is seen that the system exhibits a positive peak of 5 dB near 2 kHz in respect of heavily correlated signals as indicated by curve $H_3$ and a negative peak of about 5 dB at 2 kHz as indicated by curve $L_3$ which is substantially inverse to curve $H_3$. Thus, the adjustment of the attenuators to have an intermediate value of scaling the undesirable consequences of positive and negative peaks are reduced to one half as compared with the adjustments $K_1=K_2=0$ or $K_1=K_2=1$.

In the foregoing description the attenuators have been adjusted so that they have an equal scaling factor. However, it is also possible to have different scaling factors for $K_1$ and $K_2$. This will increase the range of acoustic characteristics of the system to meet the specific preference of the user.

Figure 6:
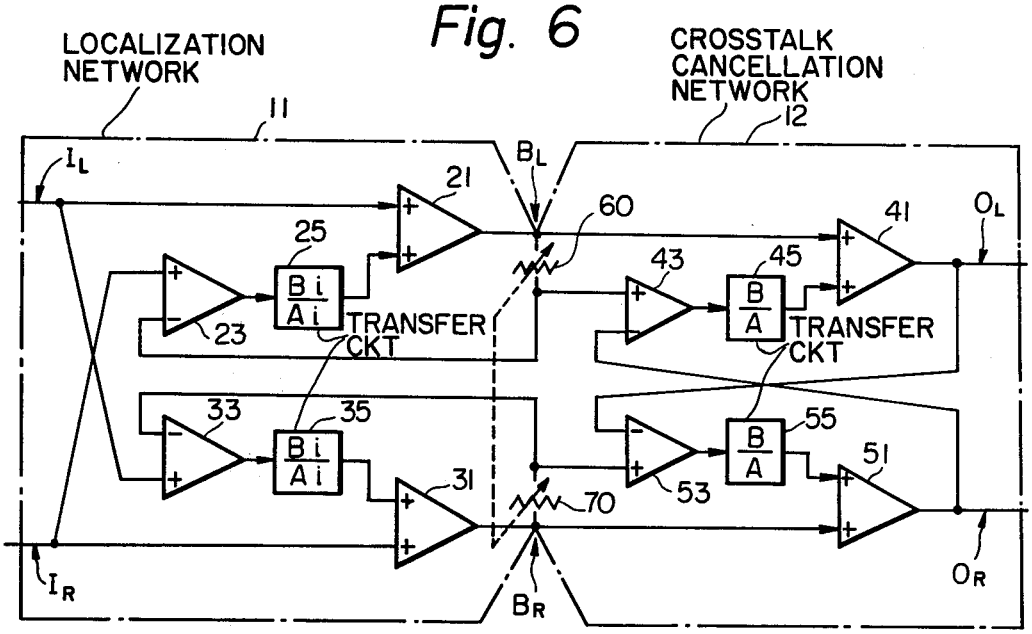
FIG. 6 is an alternative embodiment of the invention.

The attenuators may alternatively be provided as shown in FIG. 6 in which the output signal from the left-channel adder 21 is coupled through an attenuator 60 to the noninverting input of the subtractor 43 and to the inverting input of the subtractor 23 so as to replace the attenuators 24 and 44 of FIG. 1. Similarly, the output signal from the right-channel adder 31 is coupled through an attenuator 70, which is ganged to attenuator 60, to the noninverting input of the right-channel subtractor 53 and to the inverting input of the subtractor 33, replacing the attenuators 34 and 54 of FIG. 1.

The transfer circuits shown and described above can be realized by the combination of a filter circuit having a predetermined frequency response and a delay or phase shifter to impart a predetermined time delay to input signals so as to meet the specific transfer functions described above.

What is claimed is:

1. Apparatus adapted to receive input stereophonic signals for deriving output signals to be applied to loudspeakers in spaced relation with respect to a listener to give him a sense of an expanded stage width, comprising in each of right and left channels: first additive circuit means having a first input terminal in receipt of said input signal applied to one of the channels, a first transfer circuit means having a transfer function representative of the ratio of the accoustic transfer function of crosstalk paths to the acoustic transfer function of direct paths between hypothetical sound sources and listener's respective ears, first subtractive circuit means having a positive input terminal in recepit of the input signal applied to the other channel and a negative input terminal in receipt of a signal from the output of said first additive circuit means of said one channel to provide an output signal to a second input terminal of said first additive circuit means through said first transfer circuit means, second additive circuit means having a first input terminal in receipt of a signal from the output of said first additive circuit means, second transfer circuit means having a transfer function representative of the ratio of the acoustic transfer function of crosstalk paths to the acoustic transfer function of direct paths between said loudspeakers and the listener's respective ears, second subtractive circuit means having a positive input terminal in receipt of a signal from the output of said first additive circuit means of said one channel and a negative input terminal in receipt of a signal from the output of the second additive circuit means of the other channel to provide an output signal to a second input terminal of said second additive circuit means through said second transfer circuit means, and means for varying the magnitude of the signals supplied to the negative input terminal of the first subtractive circuit means and to the positive input terminal of the second subtractive circuit means, the signals from the output of said second additive circuit means of said channels being the signals applied to said loudspeakers.

2. Apparatus as claimed in claim 1, wherein said magnitude varying means comprises for each channel a variable attenuator having a scaling factor ranging from zero to unity, and being ganged with the variable attenuator of the other channel.

3. Apparatus as claimed in claim 1, wherein said magnitude varying means comprises for each channel a first variable attenuator having a scaling factor ranging from zero to unity and being ganged with the first variable attenuator of the other channel and connected in a circuit to the negative input of said first subtractive circuit means and a second variable attenuator having a scaling factor ranging from zero to unity and being ganged with the second variable attentuator of the other channel and connected in a circuit to the positive input terminal of said second subtractive circuit means.

4. Apparatus adapted to receive input stereophonic signals for deriving signals to be applied to loudspeakers in spaced relation with respect to a listener to give him a sense of an expanded stage width, comprising:

a binaural localization network including a first additive circuit means having a first input terminal in receipt of a left-channel input stereophonic signal and a second input terminal, a first subtractive circuit means having a first input terminal in receipt of a right-channel input stereophonic signal and a second input terminal in receipt of an output signal from said first additive circuit means, a first transfer circuit means having a transfer function $B_i/A_i$ where $A_i$ represents the transfer function of acoustic paths from hypothetical loudspeakers to the near-side ears of said listener and $B_i$ represents the transfer function of acoustic crosstalk paths from said hypothetical loudspeakers to the far-side ears of said listener, an output signal from said first subtractive circuit means being connected through said first transfer circuit means to said second input terminal of said first additive circuit means, a second additive circuit means having a first input terminal in receipt of said right-channel signal and a second input terminal, a second subtractive circuit means having a first input terminal in receipt of said left-channel signal and a second input terminal in receipt of an output signal from said second additive circuit means, and a second transfer circuit means having the same transfer function as said first transfer circuit, an output signal from said second subtractive circuit means being connected through said second transfer circuit means to said second input terminal of said second additive circuit means, whereby a left-channel localized binaural output signal is delivered from the output of said first additive circuit means and a right-channel localized binaural output signal is delivered from the output of said second additive circuit means; and a crosstalk cancellation network including a third additive circuit means having a first input terminal in receipt of said left-channel localized binaural output signal from said localization network and a second input terminal to provide a left-channel cancellation output signal, a fourth additive circuit means having a first input terminal in receipt of said right-channel localized binaural output signal from said localization network and a second input terminal to provide a right-channel cancellation output signal, a third subtractive means having a first input terminal in receipt of said left-channel localized binaural output signal and a second input terminal in receipt of said output signal from said fourth additive circuit means, a fourth subtractive circuit means having a first input terminal in receipt of said right-channel localized binaural output signal and a second input terminal in receipt of said output signal from said third additive circuit means, a third transfer circuit means having a transfer function B/A where A represents the transfer function of acoustic paths from said loudspeakers to the near-side ears of the listener and B represents the transfer function of acoustic crosstalk paths from said actual loudspeakers to the far-side ears of said listener, an output signal from said third subtractive circuit means being connected through said third transfer circuit means to said second input terminal of said third additive circuit means, and a fourth transfer circuit means having the same transfer function as said third transfer circuit means, an output signal from said fourth subtractive circuit means being connected through said fourth transfer circuit means to said second input terminal of said fourth additive circuit means;

first adjustable signal level setting means connected in a circuit to said first input terminal of said third subtractive circuit means and to said second input terminal of said first subtractive circuit means; and second adjustable signal level setting means connected in a circuit to said first input terminal of said fourth subtractive circuit means and to said second input terminal of said second subtractive circuit means, said first and second adjustable signal level setting means being ganged to each other to provide unitary adjustment.

5. Apparatus as claimed in claim 4, wherein said first adjustable signal level setting means comprises a first attenuator connected in a circuit to the second input terminal of said first subtractive circuit means and a second attenuator connected in a circuit to said first input terminal of said third subtractive circuit means and ganged with said first attenuator, and wherein said second adjustable signal level setting means comprises a third attenuator connected in a circuit to the second input terminal of said second subtractive circuit means and a fourth attenuator connected in a circuit to the first input terminal of said fourth subtractive circuit means and ganged with said third attenuator.

* * * * *